US010791863B2

(12) United States Patent
Larsen

(10) Patent No.: US 10,791,863 B2
(45) Date of Patent: Oct. 6, 2020

(54) CORDLESS COVERING FOR SLIDING GLASS DOORS AND LARGE WINDOWS

(71) Applicant: Danelle Larsen, Las Vegas, NV (US)

(72) Inventor: Danelle Larsen, Las Vegas, NV (US)

( * ) Notice: Subject to any disclaimer, the term of this patent is extended or adjusted under 35 U.S.C. 154(b) by 302 days.

(21) Appl. No.: 15/989,142

(22) Filed: May 24, 2018

(65) Prior Publication Data

US 2018/0344068 A1 Dec. 6, 2018

Related U.S. Application Data

(60) Provisional application No. 62/514,943, filed on Jun. 4, 2017.

(51) Int. Cl.

| | |
|---|---|
| ***A47H 23/04*** | (2006.01) |
| ***A47H 19/00*** | (2006.01) |
| ***E06B 9/262*** | (2006.01) |
| ***A47H 23/01*** | (2006.01) |

(52) U.S. Cl.

CPC ..... *A47H 23/04* (2013.01); *A47H 19/00* (2013.01); *A47H 23/01* (2013.01); *E06B 9/262* (2013.01); *A47H 2201/02* (2013.01)

(58) Field of Classification Search

CPC .... A47H 2201/02; A47H 23/04; A47H 19/00; A47H 2023/025; A47H 23/01; A47H 23/02; A47H 13/14; A47H 13/16; E06B 2009/2622; E06B 2009/2625; E06B 9/262

USPC ..... 160/349.2, 348

See application file for complete search history.

(56) References Cited

U.S. PATENT DOCUMENTS

| | | | | |
|---|---|---|---|---|
| 4,326,577 | A | 4/1982 | Tse | |
| 4,986,329 | A * | 1/1991 | Kupchunos | A47H 1/142 160/330 |
| 5,025,848 | A | 6/1991 | Prochaska | |
| 5,282,505 | A * | 2/1994 | Gilley | A47H 13/14 160/348 |
| 5,547,010 | A * | 8/1996 | Stuart | A47H 1/18 160/335 |
| 5,738,159 | A * | 4/1998 | O'Brien | A47H 23/04 160/124 |
| 5,988,254 | A * | 11/1999 | Hanright | E06B 9/262 160/264 |
| 7,195,051 | B2 | 3/2007 | Nien | |
| 7,942,186 | B2 | 5/2011 | Lassiter | |
| 9,822,582 | B2 | 11/2017 | Larsen | |
| 2005/0199356 | A1 | 9/2005 | Nien | |
| 2005/0241782 | A1* | 11/2005 | Nien | A47H 23/04 160/330 |
| 2006/0086469 | A1* | 4/2006 | Nien | E06B 9/40 160/243 |
| 2007/0006982 | A1* | 1/2007 | Lassiter | A47H 23/04 160/349.2 |

(Continued)

*Primary Examiner* — Brian D Mattei
*Assistant Examiner* — Matthew J Gitlin

(57) ABSTRACT

Disclosed herein is a cordless covering for a sliding glass door or other large opening or window that can be arranged in at least three different configurations. In one configuration, one or more slats may be inserted into various pockets on the covering to enable an individual to gather the slats together and change a length of the covering. In a second configuration, a portion of the covering may be draped over one of the pockets of the covering to change the length of the covering. In a third configuration, the covering can be pulled to one side of the sliding glass door such that the width of the covering is changed.

20 Claims, 8 Drawing Sheets

(56) References Cited

U.S. PATENT DOCUMENTS

| | | | | |
|---|---|---|---|---|
| 2008/0000595 | A1* | 1/2008 | Cohen | E06B 9/40<br>160/243 |
| 2011/0155199 | A1 | 6/2011 | Harper | |
| 2012/0193043 | A1 | 8/2012 | Bishop | |

* cited by examiner

CORDLESS COVERING FOR SLIDING GLASS DOORS AND LARGE WINDOWS

CROSS-REFERENCE TO RELATED APPLICATION

This application claims priority to U.S. Provisional Patent Application No. 62/514,943 filed on Jun. 4, 2017 and entitled "Cordless Door Covering with Vertical and Horizontal Securement Mechanisms", the entire application of which is hereby incorporated by reference in its entirety.

BACKGROUND

Coverings for sliding glass doors and large windows are typically made to be pulled vertically to one side. Once the covering has been moved to one side, additional light can enter the room in which the covering is placed. In the case of sliding glass doors, the door may be more easily opened because the covering has been moved to the side. However, this style of covering has limited versatility and is limited to one securing option.

Other coverings for sliding glass doors and large windows include motorized coverings, roller shades, bamboo shades, shutters, vertical blinds, and the like. However, these coverings are typically not made for sliding glass doors and large windows. Additionally, these coverings can be dangerous to children, break easily, are costly to replace and have limited functional options.

SUMMARY

Disclosed herein is covering for a large window or sliding glass door. The covering described herein is cordless but can still be arranged in a number of different configurations.

Accordingly, described herein is a covering for a sliding glass door. In some cases, the covering includes a panel having a first side and a second side. The panel includes a plurality of horizontal pockets. Each of the plurality of horizontal pockets is positioned at a different location along a length of the first side of the panel. Additionally, each of the plurality of horizontal pockets extend substantially along a width of the first side of the panel. The covering also includes a plurality of removable slats. When the plurality of slats have been inserted into respective ones of the plurality of horizontal pockets, the covering can be manipulated in a first manner in which a length of the covering is changed from a first length to a second length. When the slats are removed from each of the plurality of horizontal pockets, the covering can be manipulated in a second manner in which a lower portion of the panel is positioned through an opening between at least one of the plurality of horizontal pockets and the first side of the panel to change the length of the covering from the first length to a third length and in a third manner in which the width of the covering may be changed from a first width to a second width. The covering may also include a strap having a first end and a second end. The first end is coupled to the second side of the panel and the second end may be removably coupled to a first side of the panel when the covering has been manipulated in the first manner in order to secure the covering at the second length.

Also described is a method for manipulating a covering for a window. The method includes manipulating the covering in a first manner by inserting a plurality of slats into respective ones of a plurality of horizontal pockets, each of which extend at least partially along a width of a first side of the covering. Additionally, at least one of the plurality of slats is used to manipulate the covering such that a length of the covering is changed from a first length to a second length. The manipulated portion of the covering is then secured using one or more straps that are coupled to a second side of the covering. The covering may also be manipulated in a second manner by inserting a lower portion of the covering through an opening between at least one of the plurality of horizontal pockets and a first side of the panel such that the lower portion of the covering drapes over the at least one of the plurality of horizontal pockets and changes the length of the covering from the first length to a third length when the slats have been removed from the plurality of horizontal pockets. The covering may also be manipulated in a third manner by moving a first edge of the covering closer to a second edge of the covering to change a width of the covering when the slats have been removed from the plurality of horizontal pockets.

The present disclosure also describes a cordless covering for a window. The cordless covering includes a plurality of horizontal pockets each of which are positioned at a different location along a length of a first side of the covering. The cordless covering also includes a plurality of removable slats that, when inserted into respective ones of the plurality of horizontal pockets, enable the covering to be manipulated in a first manner to change a length of the covering from a first length to a second length. When the slats are removed from the plurality of horizontal pockets, the covering can be manipulated in a second manner in which a lower portion of the panel is draped over at least one of the plurality of horizontal pockets to change the length of the covering from the first length to a third length or manipulated in a third manner in which a width of the covering is changed from a first width to a second width.

BRIEF DESCRIPTION OF THE DRAWINGS

This disclosure will be readily understood by the following detailed description in conjunction with the accompanying drawings, wherein like reference numerals designate like structural elements, and in which.

DETAILED DESCRIPTION

Figure 1B:
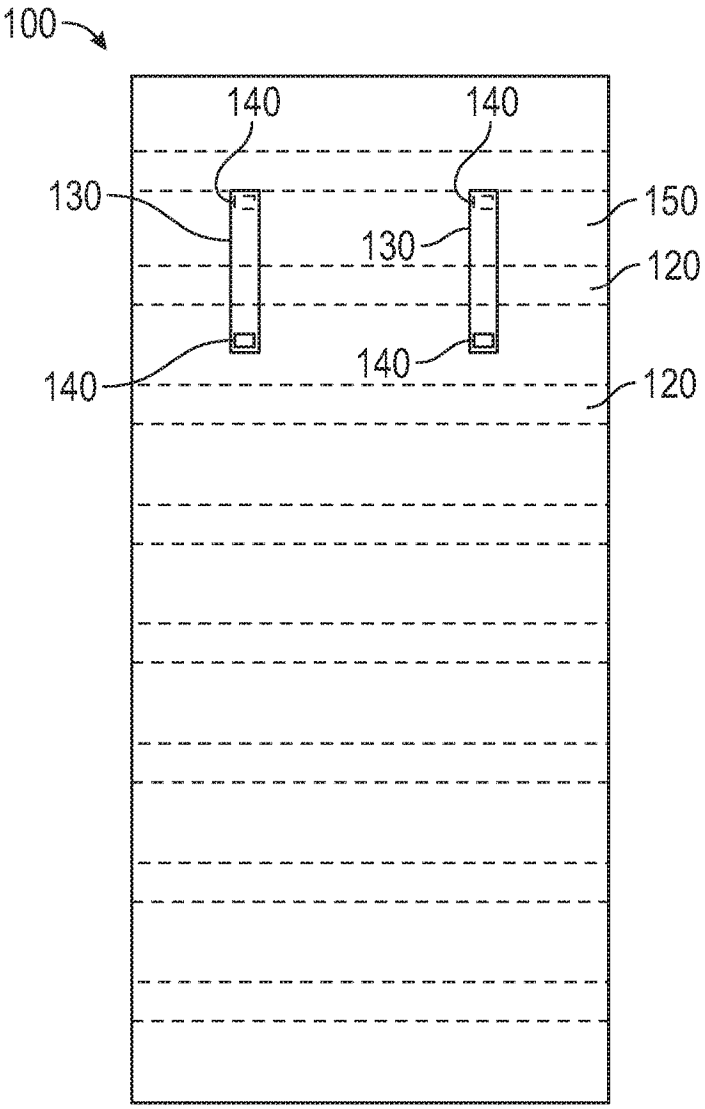
FIG. 1B illustrates a second side of the covering of FIG. 1A according to an example.

Reference will now be made in detail to representative examples illustrated in the accompanying drawings. It should be understood that the following descriptions are not intended to limit the examples to one preferred implementation. Rather, the described examples are intended to cover alternatives, modifications, and equivalents as can be included within the spirit and scope of what is described herein and as defined by the claims that are included herewith.

The present disclosure is directed to a cordless covering that may be configured in numerous ways. In some instances, the covering is for sliding glass doors and/or other large openings or windows. As will be explained in detail below, the cordless covering may be folded, gathered or rolled and configured in a second manner such that a length of the cordless covering changes from a first length to a second length that is less than the first length.

When configured in this manner, the folded, gathered or rolled portion of the cordless covering may be secured by a strap that is positioned on a second side of the cordless covering. For example, the strap may extend from the second side of the covering and over the manipulated portion of the covering. One end of the strap may then be secured to a first side of the cordless covering. In some instances, the strap may include a securement mechanism that can be used to couple the strap to one or more of the second side of the cordless covering and the first side of the cordless covering. In some cases, the securement mechanism can be a button, a hook, a hook and loop fastener, a magnet or other fastening agent.

In this configuration, the cordless covering may also include one or more slats that are removably inserted into various pockets that are contained on the first side (and/or the second side) of the cordless covering. When the slats are inserted into the pockets, the cordless covering may be more easily manipulated when compared to manipulation in the same manner when the slats are removed. For example, the slats make folding, rolling and/or gathering the cordless covering in a vertical manner easier than if the slats were removed from the pockets. Although the slats are helpful in rolling or folding the covering, the covering may be rolled or folded when the slats have been removed.

The cordless covering can also be manipulated in a second manner such that the cordless covering can be arranged in a second configuration. For example, a lower portion of the cordless covering may be lifted and inserted between one of a plurality of pockets (e.g., the pockets that receive the removable slats) and a first side of the cordless covering such that the lower portion of the cordless covering is draped over the at least one of the pockets. Manipulation of the cordless covering in this manner also changes a length of the cordless covering.

The cordless covering may also be manipulated in a third manner such that one side of the covering may be moved toward the other side of the covering and/or moved to one side or the other of a sliding glass door, a window or other opening such that a width of the cordless covering changes from a first width to a second width that is less than the first width.

These and other examples will be further described with reference to FIG. 1A-FIG. 7.

Figure 1A:
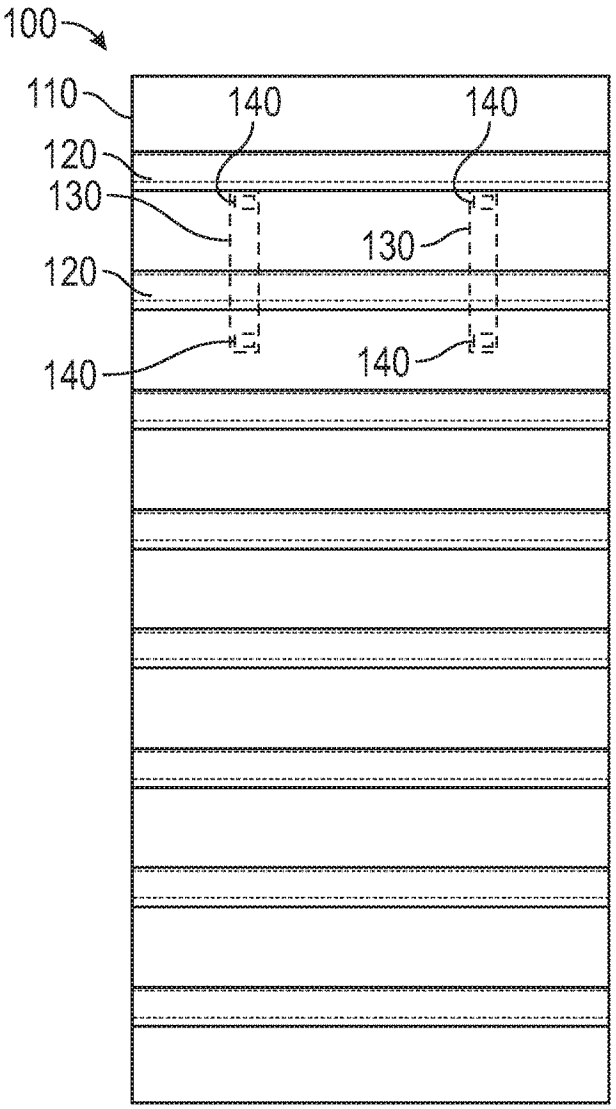
FIG. 1A illustrates a first side of a covering according to an example.

FIG. 1A illustrates a first side 110 of a covering 100 according to an example. The covering 100 may be used to cover a sliding glass door. Although the term sliding glass door is used throughout this disclosure, the covering 100 may be used to cover any opening such as, but not limited to, a window, a closet, a doorway, and the like. In other examples the covering 100 may be used as a shower curtain. In some examples, the covering 100 has dimensions that are more suitable for large openings, large windows and the like. Further, although a single covering 100 is shown in some of the figures, it is contemplated that multiple coverings (such as, for example covering 200A and covering 200B of FIG. 2) may be used to cover a single sliding glass door, window and the like. That is, a sliding glass door may have two or three coverings 100 each of which may be manipulated in the same manner as one another or in a different manner from one another.

The covering 100 may be comprised of single panel. In other cases, the covering 100 may be made up of multiple smaller panels that are coupled together. For example, the multiple smaller panels may be coupled together to form the larger panel. In some cases, the smaller panels may be removably coupled to one another.

The covering 100 may have one or more designs, colors, patterns and/or shapes. Further, the covering 100 may have varying dimensions depending on the type of opening in which the covering is to be used. For example, the covering 100 may have a first set of dimensions to cover an opening (e.g., a window, a door and the like) of a first size. Likewise, the covering 100 may have a second set of dimensions to cover an opening of a second size.

The covering 100 may be made from a variety of materials. For example, the covering 100 may be made from any type of textile, fabric, cloth, or other such material. The covering 100 may be made with multiple layers of (e.g., multiple layers of the same or different fabric) or with a single layer. In some implementations, the covering 100 may be made from plastic, wood, polymers, alloys and so on. In still yet another embodiment, the covering 100, or portions of the covering 100, may be made from any malleable, foldable or bendable material.

The covering 100 has a first side 110 and a second side 150. The first side 110 has a plurality of pockets 120 that extend horizontally across the covering 100. In some instances, the pockets 120 extend completely across a width of the covering 100. In other instances, the pockets 120 may extend partially across a width of the covering 100. The pockets 120 may be evenly spaced apart from one another along a length of the covering. The pockets 120 may also have openings on one side (or both sides) such that a slat (such as will be shown and described below with respect to FIG. 3) may be inserted into and removed from each of the pockets 120. The slats are used to help individuals more easily manipulate the covering 100 when changing a length of the covering 100 such as will be described in more detail below.

FIG. 1B illustrates a second side 150 of the covering 100 of FIG. 1A according to an example. The second side 150 of the covering 100 includes one or more straps 130. In some instances, the straps 130 may be permanently coupled to the second side 150 of the covering 100. In other cases, the one or more straps 130 may be removably coupled to the second side 150 covering 100.

For example, the straps 130 may include one or more securement mechanisms 140 that are used to couple the straps 130 to the covering 100. The securement mechanisms may be snaps, magnets, hook and loop fasteners, hooks, buttons or any other fastening mechanism that may be used to removable coupled the straps 130 to the covering 100. When removably coupled to the covering 100, the straps 130 may be positioned at different locations on the second side 150 (or the first side 110) of the covering 100. Although two straps 130 are shown, any number of straps 130 may be used and may be permanently or removably coupled to different positions on the first side 110 and/or the second side 150 of the covering 100.

As will be described in more detail below, the straps 130 may be used to secure at least a portion of the covering 100 when the covering has been manipulated to change a length of the covering 100. The straps 130 may also be used to secure the covering 100 at one side of the sliding glass door when the covering 100 has been manipulated in another manner in which the width of the covering 100 has been changed (e.g., the straps 130 may be wrapped around the covering 100 when the covering 100 has been drawn to one side of the sliding glass door).

Figure 2:
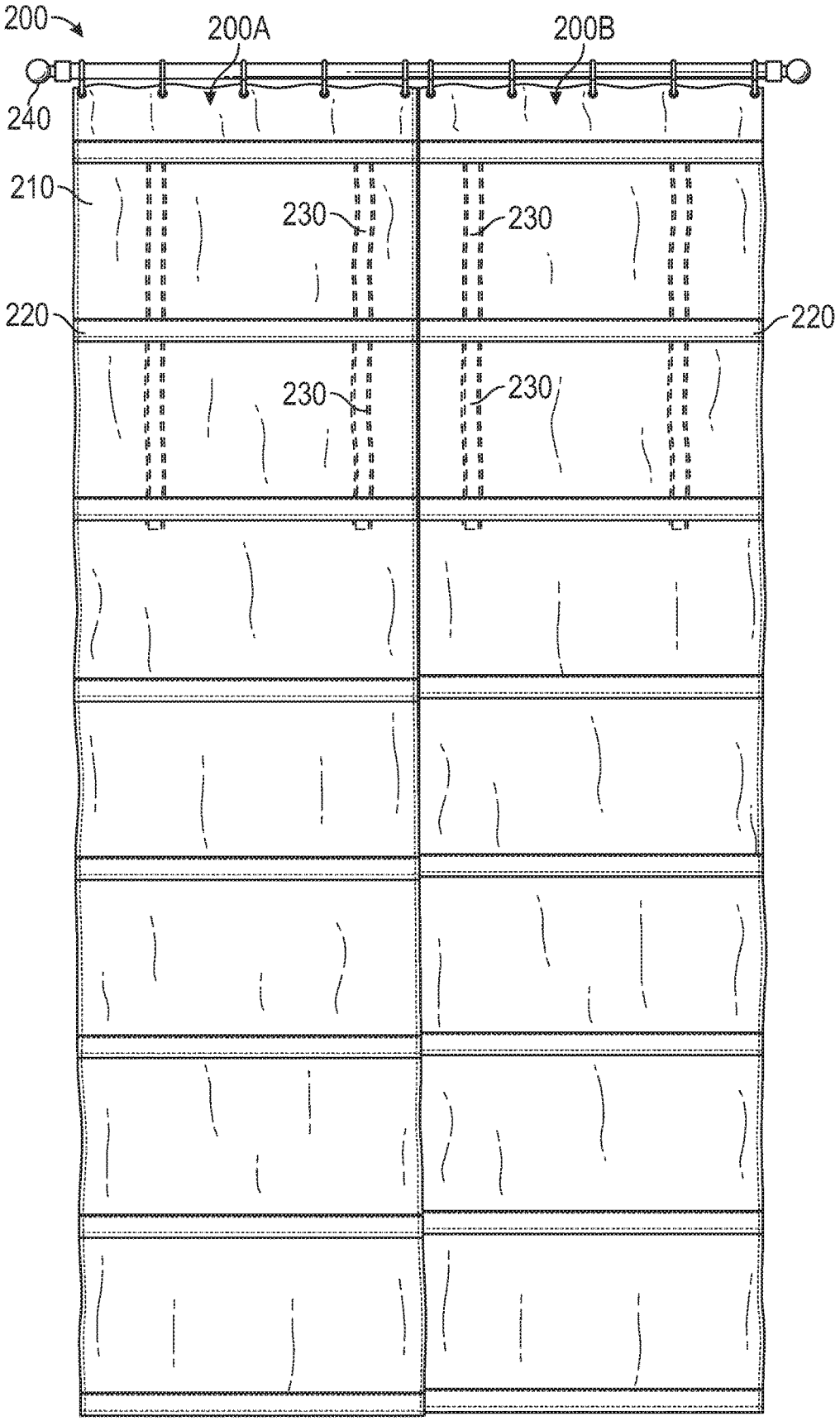
FIG. 2 illustrates a covering positioned over an opening such as a sliding glass door or a window according to an example.

FIG. 2 illustrates a covering 200 that is coupled to a rod 240 and positioned over a sliding glass door 250 (shown in FIG. 4B) according to an example. In this example, the covering 200 includes a first covering 200A and a second covering 200B. Although two separate coverings 200A and 200B are shown, each may be referred to as covering 200. However, it should be noted that while covering 200A and covering 200B are identical in functionality. As such, each of covering 200A and covering 200B may be manipulated separately but be configured in the same configuration or in different configurations.

The covering 200 may be similar to the covering 100 shown and described with respect to FIG. 1A and FIG. 1B. For example, the covering 200 has a number of pockets 220 on the first side 210 of the covering 200 that are spaced apart from one another along a length of the covering 200. In this example, the pockets 220 extend across a width of the covering 200. However, the pockets 220 may extend substantially across a width of the covering 200 or partially across a width of the covering 200. The covering 200 also includes various straps 230 that function in a similar manner such as described above.

In the example shown in FIG. 2, the covering 200 is secured to a rod 240 such as for example, a curtain rod. Although a rod 240 is shown, the covering 200 may be placed over a sliding glass door 250, a window or other opening using any number of different mechanisms. As also shown in FIG. 2, the covering 200 is in an unmanipulated configuration. That is, in this example, the covering 200 is shown as having its unmanipulated standard length and standard width.

Figure 3:
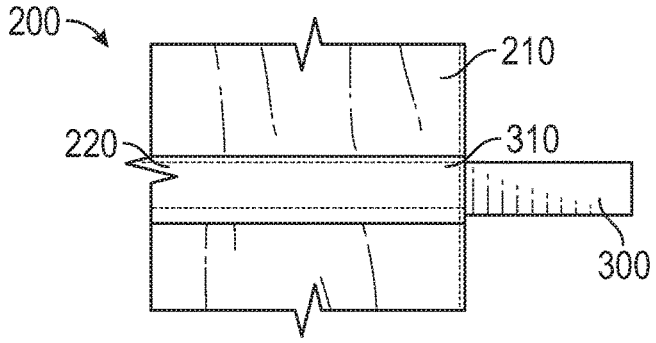
FIG. 3 illustrates a closeup of covering that shows a removable slat being inserted into or removed from one or more pockets of the covering according to an example.

In some instances, and when the covering 200 is in its unmanipulated state, various slats, such as, for example, slats 300 shown in FIG. 3, may be inserted into various pockets 220. More specifically, FIG. 3 shows how a removable slat 300 can be inserted into and removed from one or more pockets 220 of the covering 200 according to an example.

In some instances, the slat 300 may be made of plastic, wood, aluminum or any other suitable material that may provide structure to covering 200. As shown, the slat 300 may be inserted into an opening 310 located on an edge of the pocket 220. In some cases, the length and width of the slat 300 may correspond to the length and width of the pocket 220 such that the slat 300 may be inserted completely into the pocket 220.

In some examples, the slat 300 may be magnetized and/or include one or more magnets that enable the various slats to be removably coupled together when a first slat is placed on or near a second slat when the covering 200 is manipulated in a first manner such as will be described below.

As briefly discussed above, the slat 300 may provide structure to the covering 200. In some cases, various slats 300 may be inserted into the various pockets 220 of the covering 200 when the covering 200 is in its unmanipulated state such as shown in FIG. 2. The slats 300 can also be removed from the pockets 230 when the individual wishes to manipulate the covering 200 in a second manner (described below with respect to FIG. 5A and FIG. 5B) and a third manner (described below with respect to FIG. 6).

However, when the slats 300 have been inserted into the pockets 220, the slats 300 enable an individual to more easily manipulate the covering in a first manner. That is, it may be easier for an individual to manipulate the covering 200 in the first manner (described below with respect to FIG. 4A and FIG. 4B) when the slats 300 have been inserted into the pockets 220 of the covering 200 when compared to manipulating the covering 200 in the first manner when the slats 300 have been removed from the pockets 220.

Figure 4A:
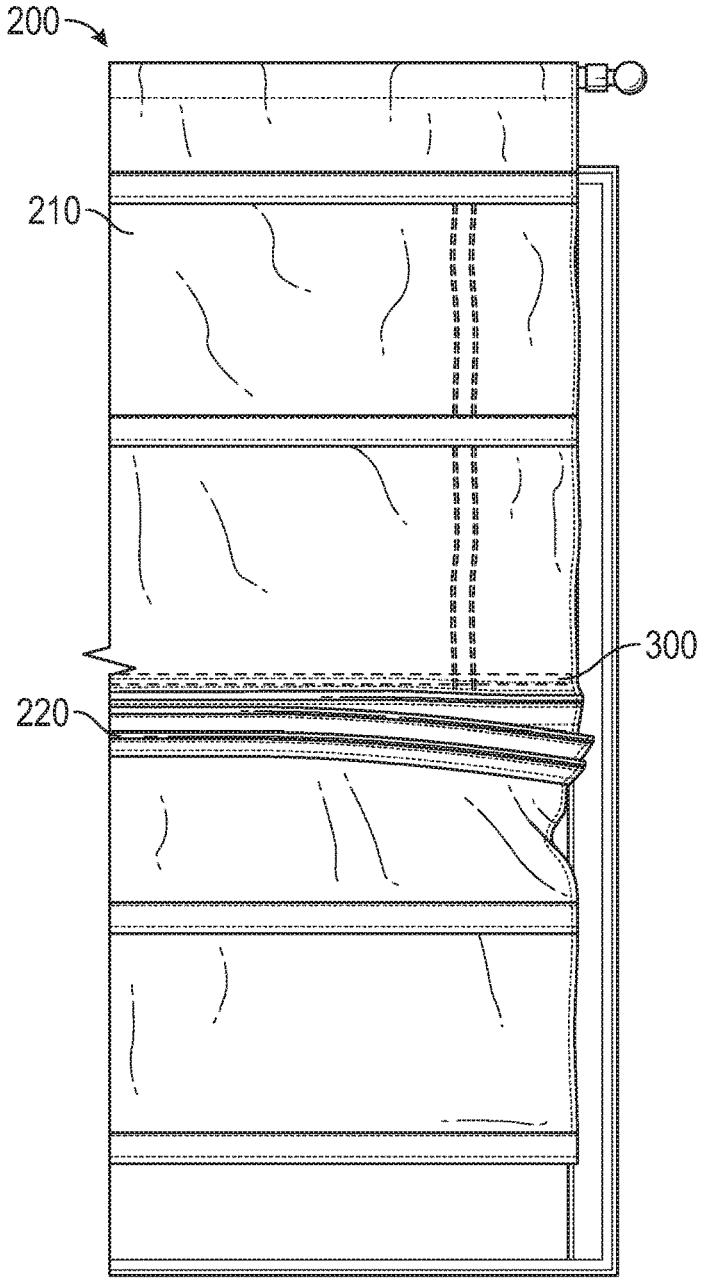
FIG. 4A illustrates how the covering of FIG. 2 can be manipulated such that it is arranged in a first configuration according to an example.

For example and turning to FIG. 4A, FIG. 4A illustrates how the covering 200 of FIG. 2 can be manipulated in a first manner such that it is arranged in a first configuration in which a length of the covering is changed from a first length to a second length. For example, once one or more slats 300 have been inserted into one or more pockets 220 on the first side 210 of the covering 200, an individual may gather two or more slats 300 together which changes the length of the covering 200 from a first length to the second length. Once the desired length has been achieved, one or more straps 230 (FIG. 2) may be used to secure the gathered portion of the covering 200. Although the slats 300 may be helpful in manipulating the covering in the first manner, the covering may be manipulated such as shown when the slats 300 are removed. That is, the covering may be rolled or folded with or without the slats 300.

Figure 4B:
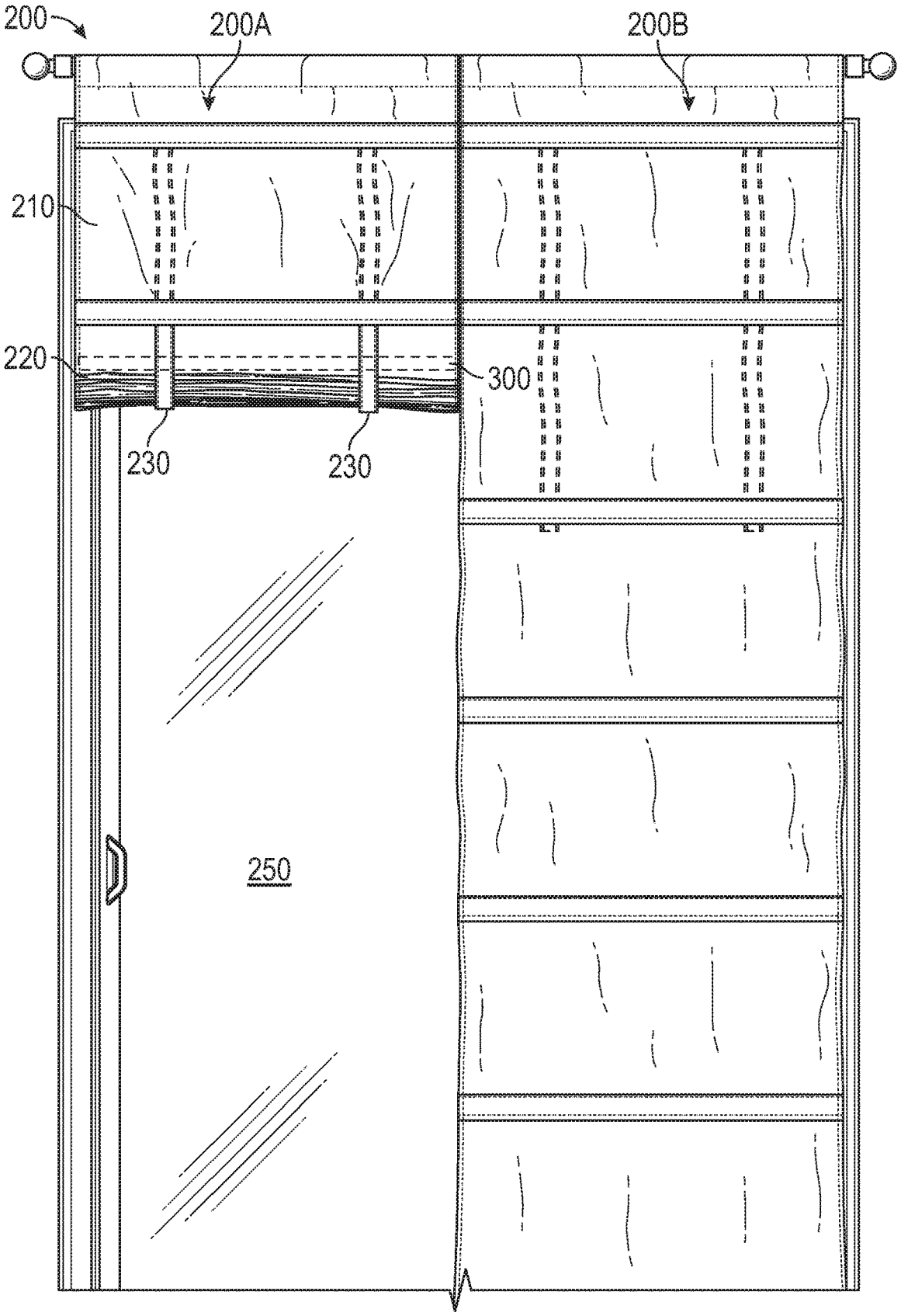
FIG. 4B illustrates the covering of FIG. 2 in the first configuration according to an example.

FIG. 4B illustrates the covering 200 of FIG. 2 in the first configuration according to an example. As shown in FIG. 4B, once the pockets 220 with the slats 300 have been gathered together, straps 230 that extend from the second side of the covering 200, wrap around the gathered portion of the covering 200 and are secured to the first side 210 of the covering thereby holding the gathered portion of the covering 200 at the desired height.

Although gathering the pockets 230 with slats 300 is specifically mentioned, the slats 300 may also be used to roll or fold the covering 200 in order to change its length. For example, a slat 300 may be inserted into one of the lower pockets 230 on the covering and the individual may roll or fold the covering to the desired length. The straps 230 may then be placed around the rolled or folded portion of the covering 200 to secure the covering 200 at the desired length.

As discussed above, the straps 230 may be removably coupled to the covering 200 such that the straps 230 may be placed at any number of different positions on the covering 200 and used to secure the covering 200 at a number of different lengths.

As with the other configurations described herein, FIG. 4B shows that covering 200A may be manipulated in the first manner while covering 200B is in its unmanipulated state. However, other combinations are contemplated. For example, covering 200B may be manipulated in a similar manner to covering 200A. Alternatively, covering 200B may be manipulated in a second manner (shown in FIG. 5B) or in third manner (shown in FIG. 6).

Figure 5A:
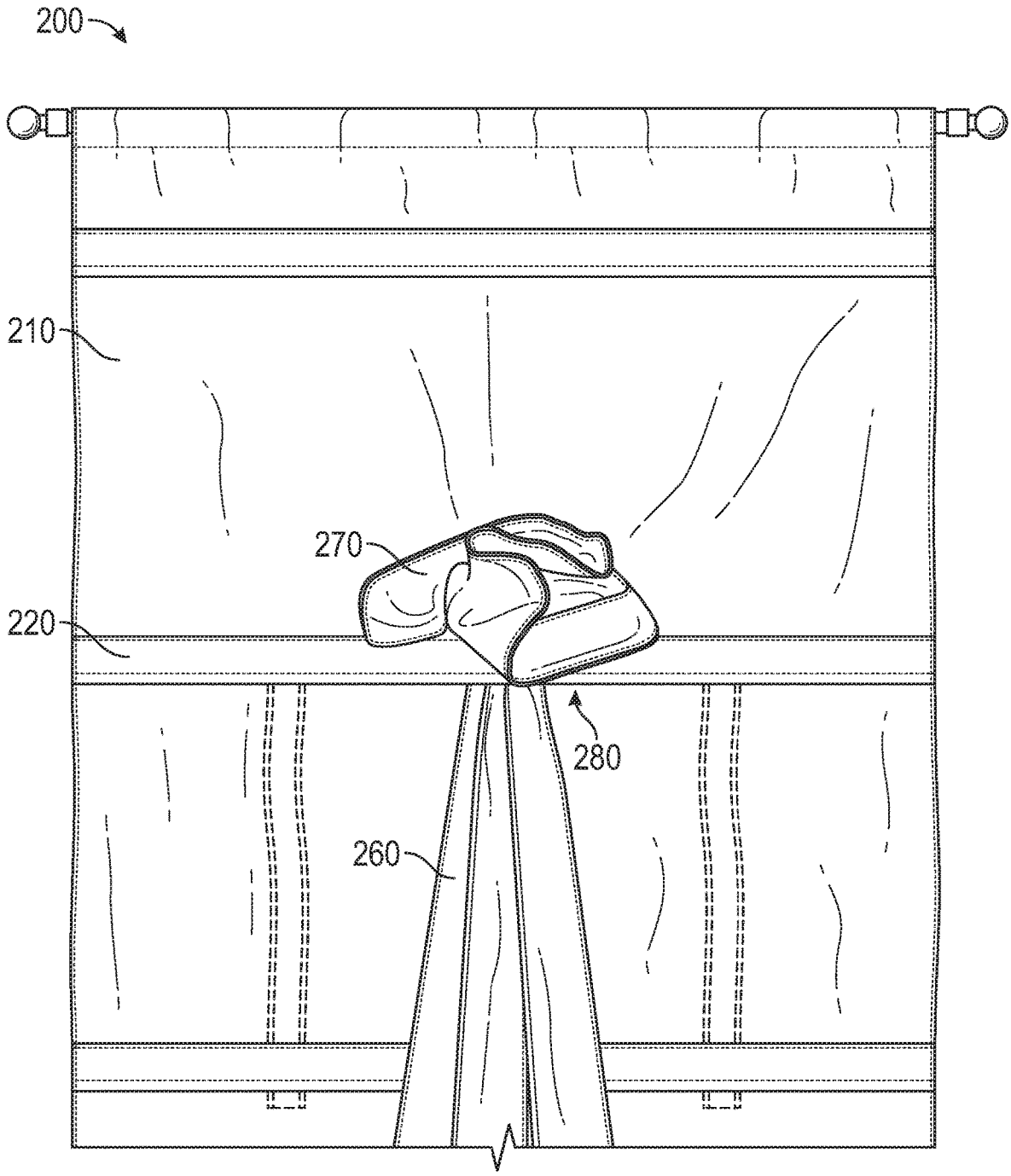
FIG. 5A illustrates how the covering of FIG. 2 can be manipulated such that it is arranged in a second configuration according to an example.

FIG. 5A illustrates how the covering 200 of FIG. 2 can be manipulated in a second manner such that it is arranged in a second configuration according to an example. Manipulation of the covering 200 in the second manner changes a length of the covering 200 from a first length (shown in FIG. 2) to a third length that is less than the first length.

As shown in FIG. 5A, an individual can take a lower portion 270 of the covering 200 and insert it through an opening 280 that is formed between the first side 210 of the covering and a particular pocket 220. In some cases, manipulating the covering 200 in such a manner exposes at least a portion of the second side 260 of the covering 200.

Figure 5B:
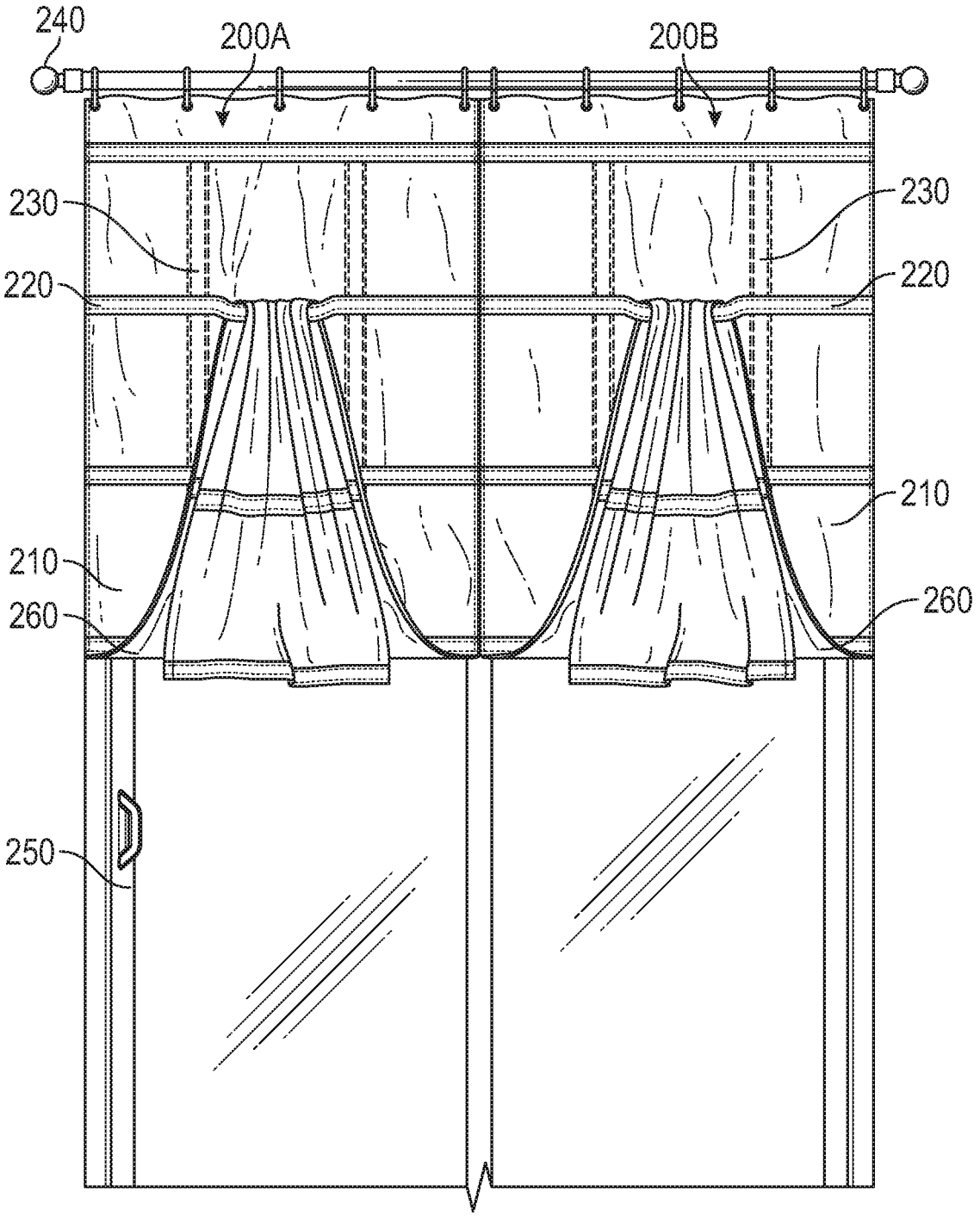
FIG. 5B illustrates the window covering of FIG. 2 in the second configuration according to an example.

Once the lower portion 270 of the covering 200 has been inserted through the opening 280 between the first side 210 of the covering 200 and the pocket 220, the covering 200 may be draped over the pocket 220 such as shown in FIG. 5B. In some cases, an opening 280 may exist between any number of the pockets 220. That is, each pocket 230 (or some of the pockets 230) may include the opening 280 such that the lower portion 270 of the covering 200 may be inserted through the opening 280 and draped over the pocket 220.

Although FIG. 5B shows the covering 200A and 200B being manipulated in the same manner and also that the length of each covering 200A and 200B is substantially similar, covering 200A may be configured in a first manner and covering 200B may be configured in a second manner and/or have different lengths.

Figure 6:
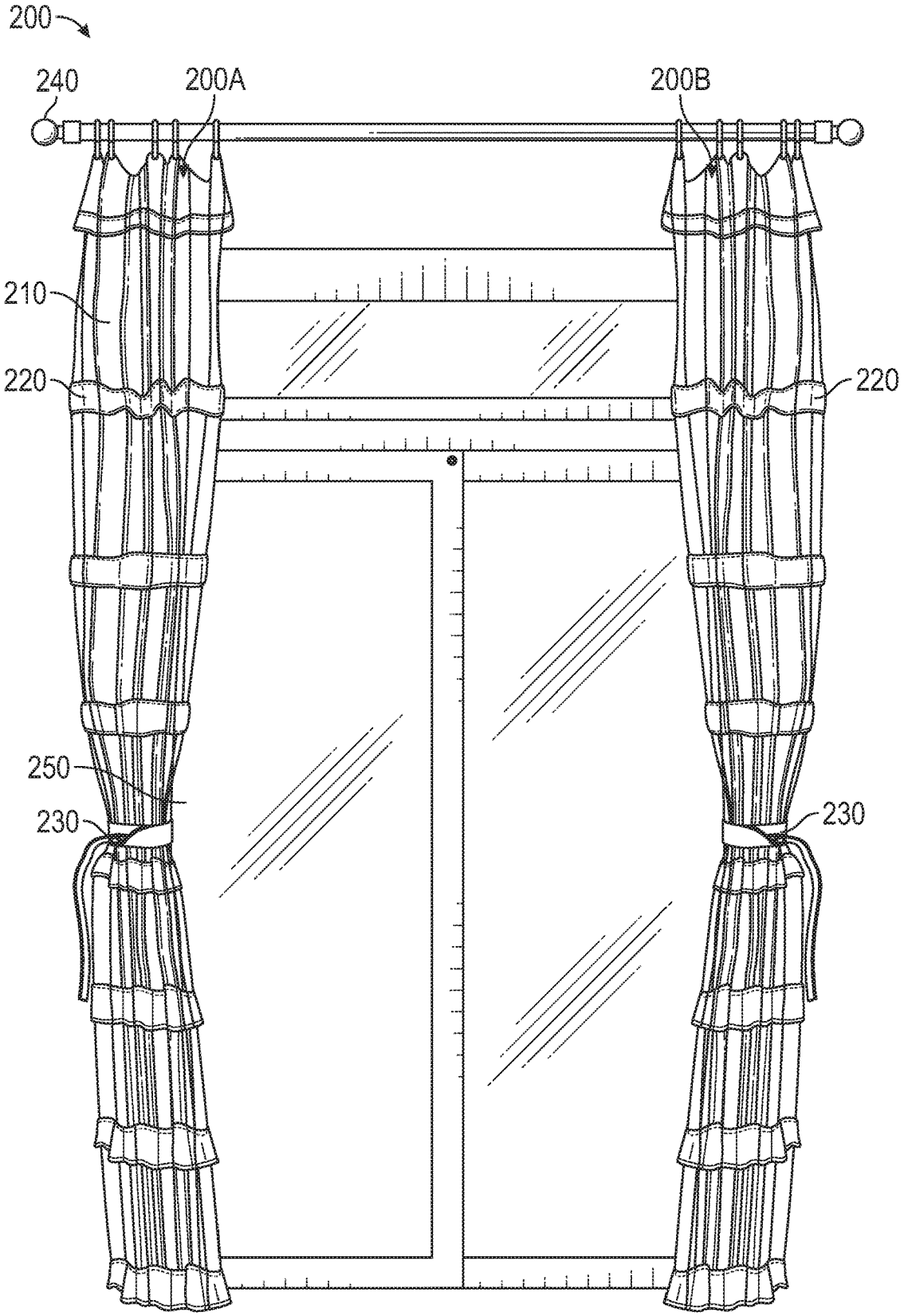
FIG. 6 illustrates the covering of FIG. 2 in a third configuration according to an example.

For example, covering 200A may be manipulated by being drawn to one side of the sliding glass door (such as shown in FIG. 6) while covering 200B may be manipulated in the second manner such as shown in FIG. 5B. In another example, covering 200A may be draped over a pocket 220 at a first height such that the covering 200A has a first length and the covering 200B may be draped over a pocket 220 at a second height such that the covering 200B has a second length that is different than the first length.

FIG. 6 illustrates the covering 200 of FIG. 2 in a third configuration according to an example. In the example shown in FIG. 6, each of covering 200A and covering 200B have been manipulated (e.g., pulled or drawn) to both sides of a sliding glass door 250 such that the width of the covering 200 has been changed from a first width (shown in FIG. 2) to a second width that is less than the first width.

Once manipulated in such a manner, the covering 200 may be secured using a strap 230. In some instances, the strap 230 may be the strap 230 that was removably coupled to the second side of the covering 200. That is, the strap 230 may be removed from the second side 260 (FIG. 5A) of the covering 200 and be used to secure the covering 200 in this manipulated configuration. In other instances, the strap 230 may be a different strap.

Although covering 200A and covering 200B are shown as being drawn on opposite sides of the sliding glass door 250 and each secured with different straps 230, covering 200A and covering 200B may be drawn or otherwise manipulated such that they are positioned on the same side of the sliding glass door 250 and secured with the same strap 230 or with different straps 230.

Figure 7:
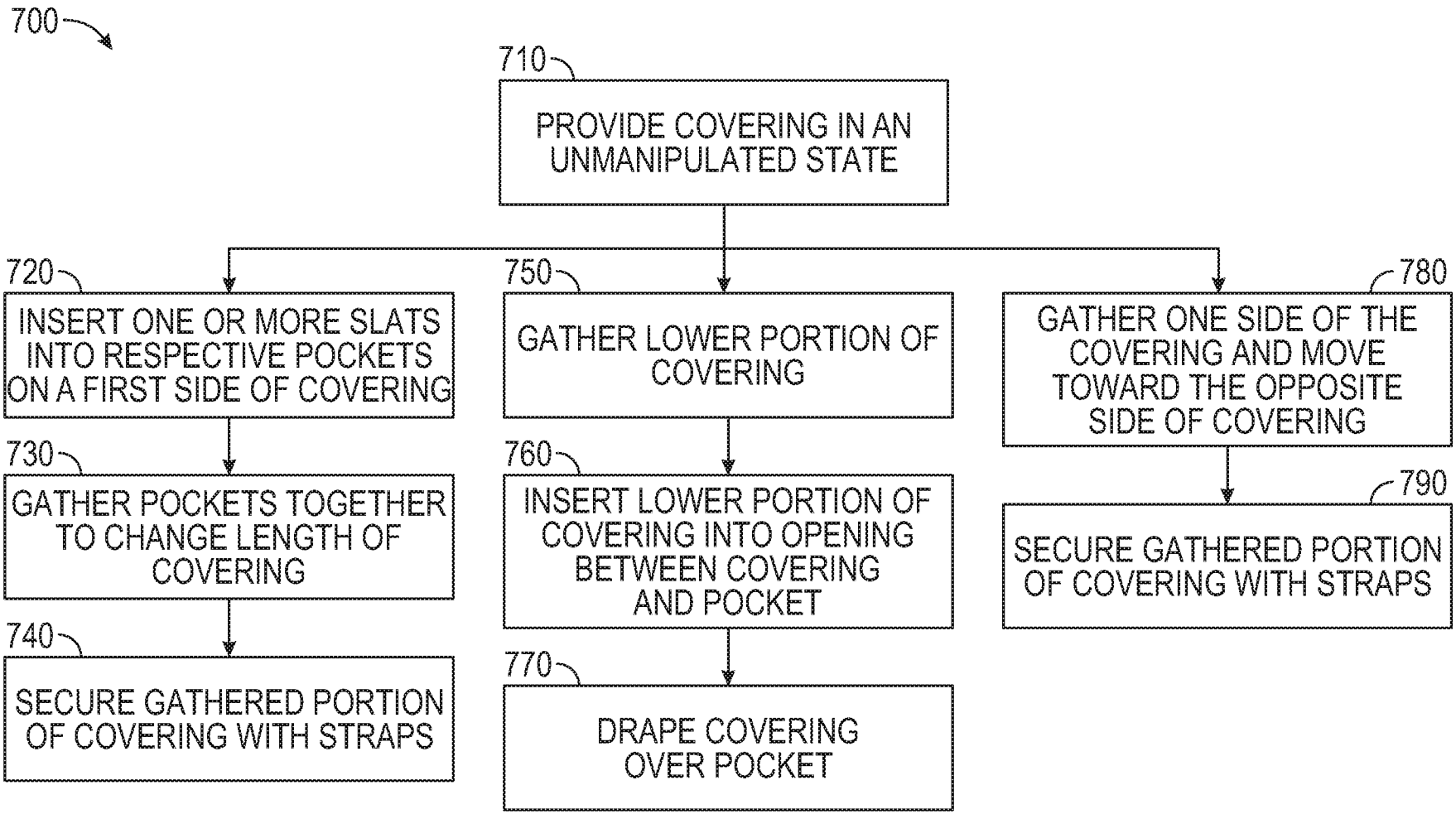
FIG. 7 illustrates a method for adjusting a length of a covering according to an example.

FIG. 7 illustrates a method 700 for adjusting a length of a cordless covering, such as, for example, the covering 200 shown in FIG. 2, according to an example. The method 700 may be used to manipulate the covering in the first manner shown in FIG. 4A and FIG. 4B, the second manner shown in FIG. 5A and FIG. 5B, and the third manner shown in FIG. 6.

Method 700 begins at operation 710 in which a covering is provided in an unmanipulated (or substantially unmanipulated) state. If an individual wishes to manipulate the covering in a first manner, flow proceeds to operation 720 and one or more slats are inserted into respective pockets that are located on a first side of the covering. In some instances, the slats may already be inserted into the pockets when the covering is in the unmanipulated state.

The slats may be inserted into every pocket on the covering in operation 720. In other cases, the slates may be inserted into fewer pockets. For example, if the individual wishes to roll or fold the covering to change its length, a single slat may be inserted into a lower most pocket (or other pocket). In another example, if the individual wishes to change the length of the covering such that only three of the pockets are gathered and subsequently secured with straps, slats are inserted into those three pockets only.

Once the slats have been inserted into the respective pockets, flow proceeds to operation 730 and the pockets are gathered together to change a length of the covering. As discussed above, in some cases, the pockets having slats may be gathered together by bringing one or more of the slats near the others. In other cases, the pockets with slats may be used to roll or fold the covering. In some instances, the slats may be magnetized or otherwise include one or more magnets. As such, when the slats are brought near each other, the slats may be magnetically coupled to one another. In other instances, the pockets of the covering may include various securement mechanisms (e.g., hooks, snaps, buttons, hook and loop fasteners and the like) that may be used to secure one pocket to another pocket (with or without the slats being inserted into the pockets).

Once the covering has been manipulated, flow proceeds to operation 740 and the gathered portion of the covering is secured using one or more straps or other such securement mechanisms.

If the individual wishes to manipulate the covering in a second manner, flow proceeds from operation 710 to operation 750 in which a lower portion of the covering is gathered by an individual. In some cases, slats may be present in one or more pockets of the covering. In such cases, the slats may be removed from the pockets prior to performing operation 750.

Once the lower portion of the covering has been gathered, flow proceeds to operation 760 and the lower portion of the covering is inserted into an opening between a pocket on the covering and the first side of the covering. In some cases, the pocket that is selected enables the individual to change a length of the covering to a desired length. For example, if the individual wants the covering to have a short length, the individual will select an opening associated with a higher pocket through which to insert the lower portion of the covering. If the individual wants the covering to have a longer length, the individual will select an opening associated with a lower pocket through which to insert the lower portion of the covering.

Flow then proceeds to operation 770 and a portion of the covering is draped over the pocket which secures the covering at the desired length.

If the individual wishes to manipulate the covering in a third manner, flow proceeds from operation 710 to operation 780 in which a first side of the covering is moved toward a second side of the covering and gathered by the individual. In some cases, slats may be present in one or more pockets of the covering. In such cases, the slats may be removed from the pockets prior to performing operation 780.

Flow may then (optionally) proceeds to operation 790 in which the gathered portion of the covering is secured by one or more straps. In some instances, the straps that are used in operation 790 are straps that have been removably coupled to the covering. For example, the straps used in operation 790 may be the same straps that were used in operation 740 but that have been removed from the second side of the covering. In other cases, the straps used in operation 790 are different straps.

This disclosure described some examples of the present disclosure with reference to the accompanying drawings, in which only some of the possible examples were shown. Other aspects may, however, be embodied in many different forms and should not be construed as limited to the examples set forth herein. Rather, these examples were provided so that this disclosure was thorough and complete and fully conveyed the scope of the possible embodiments to those skilled in the art.

What is claimed is:

1. A covering for a sliding glass door, comprising:

a panel having a first side and a second side;

a plurality of horizontal pockets, wherein each of the plurality of horizontal pockets is positioned at a different location along a length of the first side of the panel and wherein each of the plurality of horizontal pockets extend substantially along a width of the first side of the panel;

a plurality of removable slats that:

when inserted into each of the plurality of horizontal pockets, enable the covering to be manipulated in a first manner in which a length of the covering is changed from a first length to a second length; and when removed from each of the plurality of horizontal pockets, enable the covering to be manipulated in a second manner in which the width of the covering is changed from a first width to a second width and a third manner in which a lower portion of the panel is positioned through an opening between at least one of the plurality of horizontal pockets and the first side of the panel to change the length of the covering from the first length to a third length; and a strap having a first end and a second end, wherein the first end is coupled to the second side of the panel and wherein the second end is removably coupled to the first side of the panel when the covering has been manipulated in the first manner in order to secure the covering at the second length.

2. The covering of claim 1, wherein the first end of the strap is removably coupled to the second side of the panel.

3. The covering of claim 1, wherein the second end of the strap includes a coupling mechanism that is used to removably couple the second end of the strap to the first side of the panel.

4. The covering of claim 1, wherein the second end of the strap is removably coupled underneath one of the plurality of horizontal pockets such that the second end of the strap is not visible when the second end is removably coupled to the first side of the panel.

5. The covering of claim 1, wherein manipulation of the covering in the first manner comprises gathering at least two of the plurality of horizontal pockets together to change the length of the covering.

6. The covering of claim 1, wherein manipulation of the covering in the first manner comprises using at least one of the plurality of horizontal pockets to roll at least a portion of the covering to change the length of the covering.

7. The covering of claim 1, wherein positioning the lower portion of the panel through the opening between the at least one of the plurality of horizontal pockets and the first side of the panel comprises draping the lower portion of the panel over the at least one of the plurality of horizontal pockets.

8. The covering of claim 1, wherein the plurality of horizontal pockets are made from a material and the panel is made from the material.

9. A method for manipulating a covering for a window, comprising:

manipulating the covering in a first manner by:

inserting a plurality of slats into respective ones of a plurality of horizontal pockets, each of which extend at least partially along a width of a first side of the covering;

manipulating at least one of the plurality of slats to change a length of the covering from a first length to a second length; and securing the manipulated portion of the covering using one or more straps that are coupled to a second side of the covering;

manipulating the covering in a second manner by:

inserting a lower portion of the covering through an opening between at least one of the plurality of horizontal pockets and the first side of the covering such that the lower portion of the covering drapes over the at least one of the plurality of horizontal pockets and changes the length of the covering from the first length to a third length when the slats have been removed from the plurality of horizontal pockets; and manipulating the covering in a third manner by:

moving a first edge of the covering closer to a second edge of the covering to change the width of the covering when the slats have been removed from the plurality of horizontal pockets.

10. The method of claim 9, further comprising securing at least a portion of the covering when the covering has been manipulated in the second manner.

11. The method of claim 10, wherein securing the at least the portion of the covering comprises wrapping another strap around the at least the portion of the covering.

12. A cordless covering for a window, comprising:

a horizontal pocket positioned at a location along a length of a side of the covering; and a removable slat that:

when inserted into the horizontal pocket, enables the covering to be manipulated in a first manner to change a length of the covering from a first length to a second length; and when removed from the horizontal pocket, enables the covering to be:

manipulated a second manner in which a lower portion of the covering is positioned through an opening between the horizontal pocket and the side of the covering to change the length of the covering from the first length to a third length; and manipulated in a third manner in which a width of the covering is changed from a first width to a second width.

13. The cordless covering of claim 12, further comprising a strap having a first end and a second end, wherein the side of the covering is a first side of the covering and wherein:

the first end is coupled to a second side of the covering; and the second end is removably coupled to the first side of the covering when the covering is manipulated in the first manner.

14. The cordless covering of claim 13, wherein the second end of the strap includes a coupling mechanism that is used to removably couple the second end of the strap to the first side of the covering.

15. The cordless covering of claim 14, wherein the coupling mechanism is selected from a group comprising a hook fastener and a loop fastener.

16. The cordless covering of claim 13, wherein the second end of the strap is removably coupled underneath the horizontal pocket such that the second end of the strap is not visible when the second end is removably coupled to the first side of the covering.

17. The cordless covering of claim 12, wherein manipulation of the covering in the first manner comprises rolling at least a portion of the covering.

18. The cordless covering of claim 12, wherein the horizontal pocket is made from a material and the panel is made from the material.

19. The cordless covering of claim 12, wherein the horizontal pocket is a first horizontal pocket and wherein manipulation of the covering in the first manner comprises moving a second horizontal pocket toward the first horizontal pocket.

20. The cordless covering of claim 12, wherein the horizontal pocket is open on a first edge in order to receive the slat and closed on a second edge to prevent the slat from being removed through the second edge.

* * * * *